US006371402B1

(12) United States Patent
Widmer et al.

(10) Patent No.: US 6,371,402 B1
(45) Date of Patent: Apr. 16, 2002

(54) APPARATUS FOR WINDING OR UNWINDING MATERIAL WEBS ONTO OR FROM A WINDING CORE

(75) Inventors: Josef Widmer, Reiden; Robert Glur, Brittnau; Erwin Mahler, Geuensee, all of (CH)

(73) Assignee: Hunkeler Ag Papierverarbeitungsmaschinen, Wikon (CH)

( * ) Notice: Subject to any disclaimer, the term of this patent is extended or adjusted under 35 U.S.C. 154(b) by 0 days.

(21) Appl. No.: 09/366,421

(22) Filed: Aug. 4, 1999

(30) Foreign Application Priority Data

Sep. 7, 1998 (DE) ..... 198 40 816

(51) Int. Cl.[7] ..... B65H 18/10

(52) U.S. Cl. ..... 242/540; 242/545; 242/564; 101/494

(58) Field of Search ..... 242/540, 545, 242/564, 394; 101/494

(56) References Cited

U.S. PATENT DOCUMENTS 1,967,202 A * 7/1934 Dalton ..... 242/540
3,182,924 A * 5/1965 Jones et al. ..... 242/545
3,519,215 A * 7/1970 Tyler et al. ..... 242/540

* cited by examiner

*Primary Examiner*—John Q. Nguyen
(74) *Attorney, Agent, or Firm*—Oliff & Berridge PLC

(57) ABSTRACT

An apparatus for winding or unwinding material webs onto or from a winding core (3) has a bearing device (5) and a drive device (9) for driving the winding core (3) that is rotatably mounted in the bearing device (5). The drive device (9) comprises a drive (10) and a torque-transmitting device (11) from the drive (10) to the winding core (3). In order to achieve the smallest possible winding-core diameter and, nonetheless, to achieve an adequate winding or unwinding speed, the torque-transmitting device (11) comprises a toothed-belt reduction gear mechanism (12).

10 Claims, 3 Drawing Sheets

APPARATUS FOR WINDING OR UNWINDING MATERIAL WEBS ONTO OR FROM A WINDING CORE

The invention relates to an apparatus for winding or unwinding material webs onto or from a winding core in accordance with the preamble to claim 1.

In printing works, it is known for products which occur in web form, such as paper webs, to be wound up on a winding core or unwound from a winding core.

The disadvantage with such known winding cores is the fact that they have a relatively large diameter in order to ensure the minimum winding or unwinding speed of the web-like product. A further disadvantage, caused by the large diameter, is the high weight and the high moment of inertia of the winding core.

The present invention is based on the object of providing an apparatus of the type cited at the beginning which makes it possible to achieve a higher winding speed with a smaller winding-core diameter.

According to the invention, the object is achieved by an apparatus having the features of claim 1.

The subclaims 2 to 11 relate to further, advantageous refinements of the invention.

The object of the invention is in particular achieved with an apparatus for winding or unwinding material webs onto or from a winding core, especially paper, textile, plastics or other material webs, comprising a bearing device for the winding core and a drive and a torque-transmitting device, coupled to the latter, for driving or braking the winding core rotatably mounted in the bearing device, the torque-transmitting device comprising a toothed-belt reduction gear mechanism operatively arranged between the drive and the winding core.

The toothed belt reduction gear mechanism has the advantage that it can be operated at a significantly higher speed than gear mechanisms known hitherto for driving winding cores, the toothed-belt reduction gear mechanism also being capable of transmitting a high torque to the winding core. As a result, the use of a winding core with a low diameter is possible, it being possible for this to be operated both at a high speed and also with a high torque. In particular when only a few webs are resting on the winding core, there is the requirement for the winding core to be operated at a high speed in order to achieve the necessary web speed. The winding operation is preferably operated in such a way that a constant force on the web is produced. It follows from this that, with increasing diameter of the coil, a higher torque is necessary in order to produce the required, in particular constant, web tension.

The fact that the torque-transmitting device comprises a toothed-belt reduction gear mechanism means that the drive can be carried out at significantly higher speeds than in the gear mechanisms, common hitherto, which permit a maximum input drive speed to the gear mechanism of only about 6000 rev/min. The reduction has the effect of a higher torque available at the winding core. In addition, toothed-belt gear mechanisms are cheaper to produce than cog gear mechanisms and are less problematic to maintain, since the lubricating and cooling problems which result in the case of cog gear mechanisms which produce heat are dispensed with. Toothed-belt gear mechanisms are also lighter than cog gear mechanisms, as a result of which lighter device designs are possible.

An additional advantage of the winding cores of low diameter is the fact that they have a low weight and a low moment of inertia. In addition, the winding core has a greater holding capacity but, given a predefined maximum external diameter of the roll, a longer paper web can be wound up. This is advantageous in particular in the case of small wound rolls, for example in the case of paper rolls.

In a particularly preferred embodiment of the apparatus of the invention, this has a bearing device for the winding core which is configured as a bearing fork and is mounted such that it can pivot about an axis of rotation between at least two positions, one of the positions corresponding to the working position, in which the winding or unwinding operation takes place, and the other, in particular horizontal, position being provided for the insertion or removal of the winding core or a wound roll formed on the winding core. In the horizontal position of the bearing fork, the winding core provided with a gearwheel can be moved without problems into engagement with a drive gearwheel on the torque-transmitting device, since in this position, during the insertion or removal of the wound roll, there are no, or only a small, wound-roll weight component which could cause tooth-on-tooth impact. In an advantageous embodiment, the toothed-belt reduction gear mechanism is connected to the bearing fork and can be pivoted easily and without problems together with the bearing fork.

The invention will be explained in more detail below using the drawing, in which.

Figure 1:
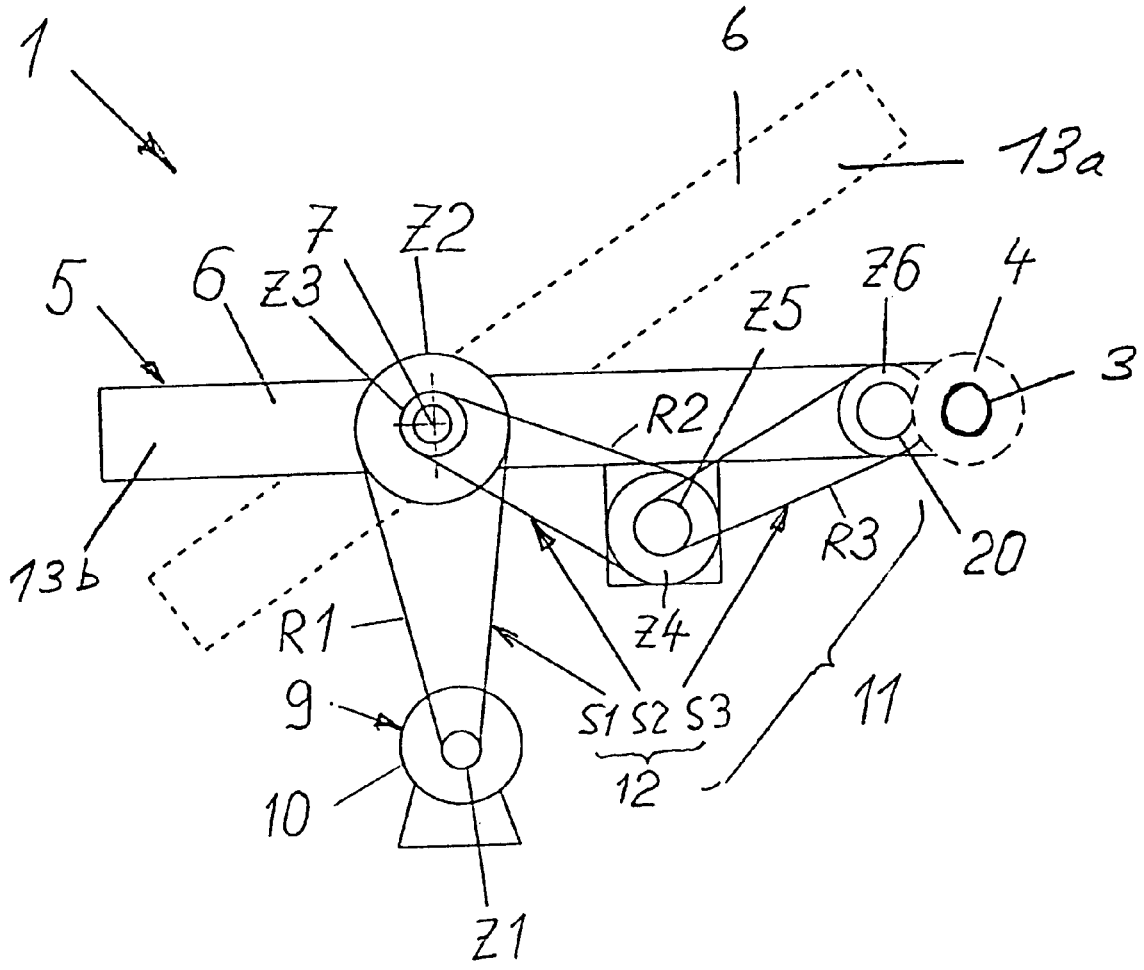
FIG. 1 shows an exemplary embodiment of a winding or unwinding apparatus in purely schematic form.
Figure 2:
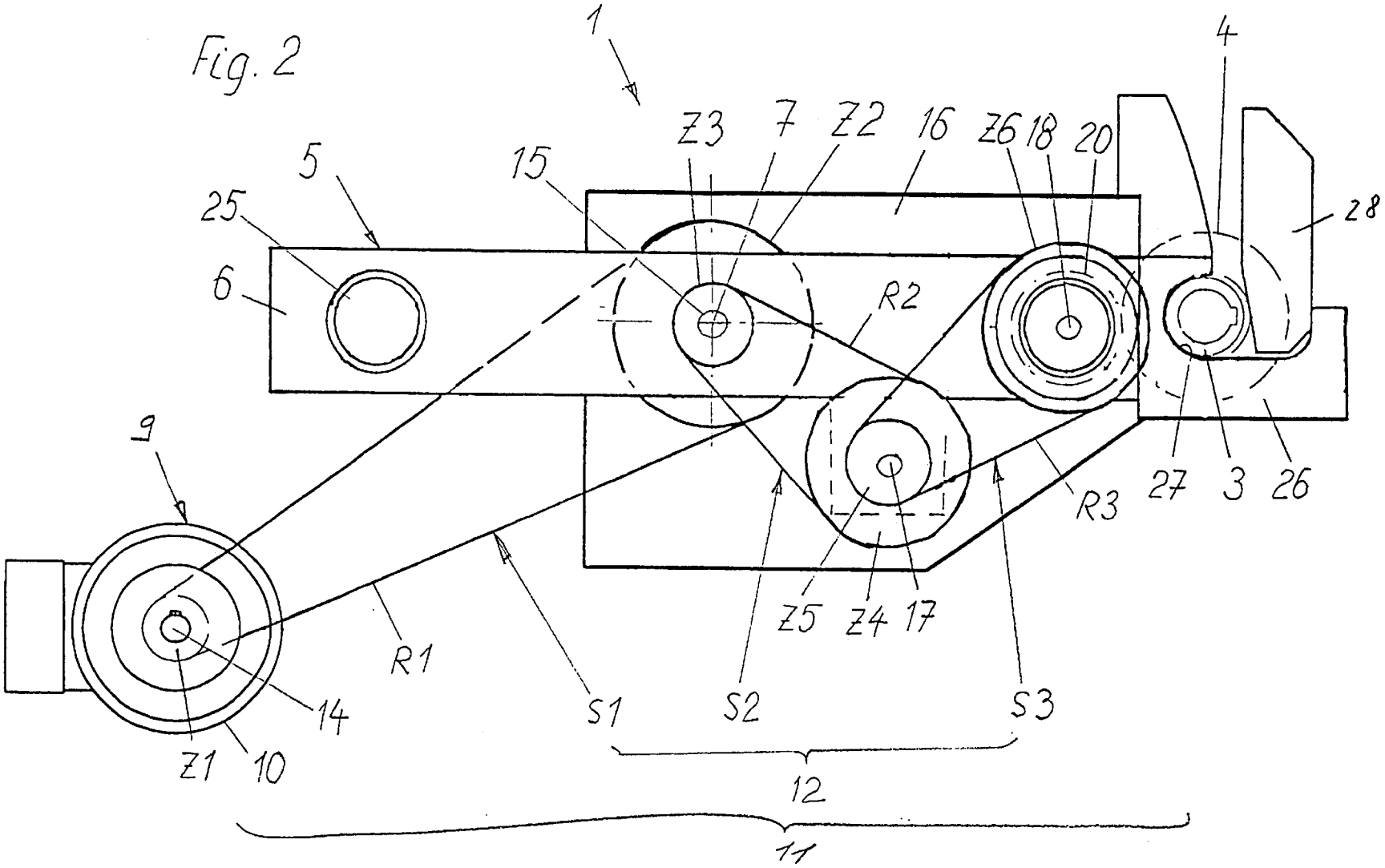
FIG. 2 shows a further exemplary embodiment in a side view.

The apparatus 1 illustrated schematically in FIG. 1 is used for winding or unwinding flexible material webs, such as paper, textile, plastics or other material webs, on a winding core 3. The winding core 3 itself in FIG. 1 is rotationally fixedly connected to the gearwheel 4, illustrated dashed. The winding core is indicated in FIG. 2 and designated there by 3. The winding core 3 is preferably configured as a mandrel.

Figure 3:
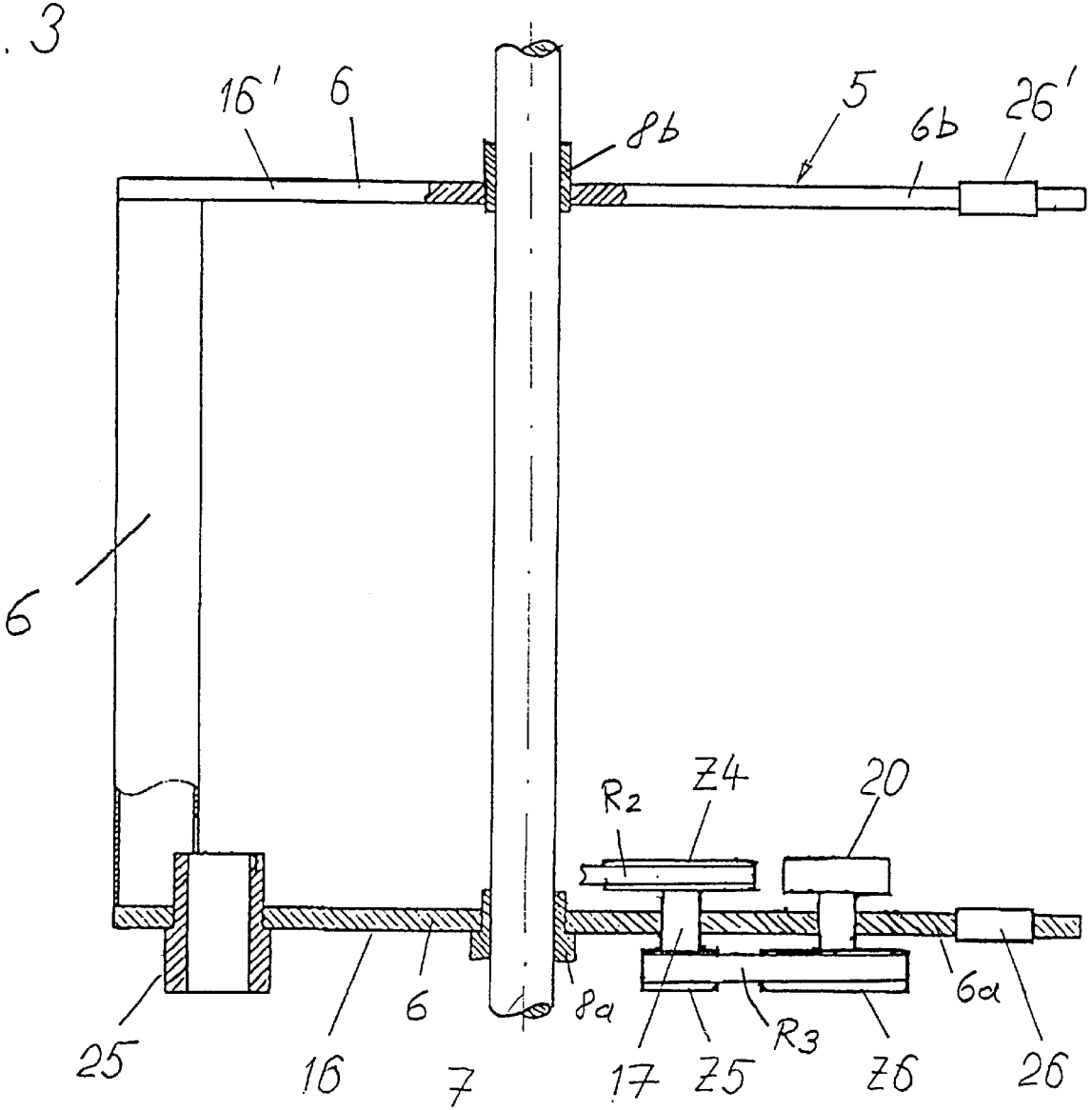
FIG. 3 shows, on a reduced scale, part of the apparatus according to FIG. 2 in plan view and partially in section.

The winding core 3 with the gearwheel 4 is rotatably mounted in a bearing device 5, which is illustrated in more detail in FIGS. 2 and 3. FIG. 1 shows, in schematic form, a bearing fork 6 which belongs to the bearing device 5 and can be pivoted between two positions 13*a*, 13*b* about an axis of rotation 7. The horizontal position 13*b* of the bearing fork 6, illustrated with solid lines, is provided for the insertion or the removal of the winding core or a wound roll formed on the winding core 3, and is also referred to as the insertion or removal position 13*b*. The other position 13*a*, illustrated dashed, corresponds to the working position, in which the winding or unwinding operation takes place.

In order to drive the winding core 3 rotatably mounted in the bearing device 5, there is a drive device 9 which comprises a motor 10. The drive 10 is preferably configured as an electric motor, it being possible for this to be operated both in a driving and in a braking mode of operation. The drive 10 is coupled, via a toothed-belt pulley Z1 to a torque-transmitting device 11. The torque-transmitting device 11 in the exemplary embodiment illustrated has a three-stage toothed-belt reduction gear mechanism 12. According to FIGS. 1 and 2, the first stage S1 is formed by a toothed-belt pulley Z1 which is rotationally fixedly connected to a drive shaft 14 and is operatively connected, via a toothed belt R1, to a toothed-belt pulley Z2 of larger diameter. The toothed-belt pulley Z2 is rotationally fixedly connected to a shaft 15 (FIG. 2), which is arranged coaxially with the axis of rotation 7 and is rotatably mounted in a fork wall 16 of the bearing fork 6. The shaft 15 is rotationally fixedly assigned a further toothed-belt pulley Z3, which forms part of the second stage S2 of the toothed-belt reduction gear mechanism 12 and, via a toothed belt R2, is operatively connected to a toothed-belt pulley Z4 of greater diameter, which is rotationally fixedly connected to a shaft 17, which is likewise rotatably mounted in the bearing fork 6. The third stage S3 of the toothed-belt reduction gear mechanism 12 is formed by a further toothed-belt pulley Z5 that is rotationally fixedly arranged on the shaft 17, a toothed belt R3 and a toothed-belt pulley Z6 which is rotationally fixedly fitted to a further shaft 18 and in turn has a greater diameter than the toothed-belt pulley Z5. Rotationally fixedly arranged on the shaft 18 is a drive gearwheel 20 which, when the winding core 3 is located in the bearing device 5, is engaged with its gearwheel 4 and forms the last part of the torque-transmitting device 11.

As can be seen from FIG. 3, the toothed-belt pulleys associated with the respective shaft, for example the toothed-belt pulleys Z4, Z5 arranged on the shaft 17, are advantageously placed on either side of the fork wall 16. The drive gearwheel 20 is also located on the inside of the fork wall 16, while the toothed-belt pulley Z6 is fitted to the outside.

The action of pivoting the bearing fork 6 is carried out by means of an additional drive, not specifically illustrated in the drawing, which is operatively connected to a lifting part designated by 25 in FIGS. 2 and 3. The lifting part 25 is located at a distance from the axis of rotation 7, specifically on the other side from two bearing parts 26, 26' (FIGS. 2 and 3), which are assigned to the two fork walls 16, 16' (FIG. 3), for the winding core 3. According to FIG. 2, each bearing part 26, 26' has a recess 27 which is designed such that the winding core 3 can be inserted from above in the horizontal position of the bearing fork 6 and, in the recesses 27, is brought in the horizontal direction into engagement with the drive gearwheel 20. As a result, when the wound roll is being inserted or removed, it is advantageously the case that there is no wound-roll weight component present, which could cause tooth-on-tooth impact of the two gearwheels 4, 20. The two gearwheels 20, 4 transmitting the force—both carried along by the bearing fork 6—then remain constantly engaged. After the winding core 3 has been inserted, a stop part 28 is moved into the position shown, in order that the winding core 3 is securely held in the recess 27. During the removal of the wound roll, which is not illustrated but is located on the winding core 3, the arm 6 is moved from the position 13*a* into the position 13*b*, and the stop part 28 is removed from the position illustrated, so that the winding core 3 can be removed from the recess 27.

As can be seen from FIG. 3, the bearing fork 6 is of U-shaped configuration with two limbs 6*a*, 6*b* which extend in parallel and which, in their end section, each have a bearing part 26, 26' to accommodate the winding core 3. In addition, the limbs 6*a*, 6*b* each have a bearing point 8*a*, 8*b* to accommodate the axis of rotation 7, so that the bearing device 5, as illustrated in FIG. 1, is mounted such that it can pivot in relation to the axis of rotation 7. The bearing parts 26, 26' and the bearing points 8*a*, 8*b* are arranged in the bearing fork 6 in such a way that the axis of rotation 7 and a mounted winding core 3 extend parallel to each other.

In an advantageous embodiment, the toothed-belt reduction gear mechanism 12 could also be of single-stage design, or have two or even more stages S1, S2, S3. The apparatus 1 according to the invention is suitable for winding material webs such as paper webs, the electric motor 10 acting as a drive during the winding operation. The apparatus 1 according to the invention is also suitable for unwinding material webs stored on the winding core 3, the electric motor acting as a drive and/or as a brake during the unwinding operation, as required, in order to produce the tension usually required in the material web.

What is claimed is:

1. An apparatus for winding or unwinding material webs onto or from a winding core, comprising:

a bearing device for the winding core;

a drive; and a torque-transmitting device, coupled to the drive, for driving or braking the winding core rotatably mounted in the bearing device, the torque-transmitting device including a toothed-belt reduction gear mechanism operatively arranged between the drive and the winding core;

wherein the torque-transmitting device ends with a drive gearwheel which is arranged on the bearing device in such a way that a winding core having a gearwheel engages with the drive gearwheel when said core is mounted thereon;

and wherein the bearing device is mounted such that it can pivot about an axis of rotation, the bearing device being capable of assuming at least an insertion or removal position and a working position, wherein in the insertion or removal position the winding core can be fitted to or removed from the bearing device by moving the winding core in the horizontal direction into engagement with the drive gearwheel, and in the working position the winding or unwinding operation takes place.

2. The apparatus as claimed in claim 1, wherein the toothed-belt reduction gear mechanism is of multi-state design.

3. The apparatus as claimed in claim 1, wherein the winding core is arranged to be higher in the working position than in the insertion or removal position.

4. The apparatus as claimed in claim 1, wherein the bearing device is configured as a U-shaped bearing fork with two limbs, which in particular extend in parallel, and wherein a bearing part to accommodate the winding core is arranged on each limb.

5. The apparatus as claimed in claim 4, wherein the toothed-belt reduction gear mechanism is connected to one of the limbs.

6. The apparatus as claimed in claim 4, wherein each limb of the bearing fork has a bearing point to accommodate an axis of rotation of the bearing device and wherein the bearing points are arranged in such a way that the axis of rotation and a mounted winding core extend in parallel.

7. The apparatus as claimed in claim 4, wherein a shaft which is rotatably mounted in the bearing fork, coaxial with the axis of rotation, is rotationally fixedly connected to a toothed-belt pulley of the tooth-belt reduction gear mechanism, said pulley being operatively connected, via a first toothed belt to a first toothed pulley that is rotationally fixedly arranged on a drive shaft.

8. The apparatus as claimed in claim 7, wherein the toothed-belt reduction gear mechanism has at least one further shaft, which is rotatably mounted in the bearing fork and is equipped with a rotationally fixedly arranged toothed pulley, said shaft being operatively connected, via at least one toothed belt, to a further toothed-belt pulley arranged on a shaft that is coaxial with the axis of rotation, and being rotationally fixedly connected to a drive gearwheel that engages with the winding-core gearwheel.

9. The apparatus as claimed in claim 8, wherein the toothed-belt pulley that is arranged on the shaft provided with the drive gearwheel is operatively connected in two stages, via two toothed belts, to the toothed-belt pulley which is arranged on the shaft that is coaxial with the axis of rotation, said toothed belts each being deflected around a toothed-belt pulley arranged on a further shaft rotatably mounted in the bearing fork.

10. A printing apparatus comprising an apparatus as claimed in claim 1.

* * * * *